United States Patent [19]

Tanabe

[11] Patent Number: 4,584,448

[45] Date of Patent: Apr. 22, 1986

[54] MICROWAVE HEATING APPLIANCE WITH SIMPLIFIED USER'S OPERATION

[75] Inventor: Takeshi Tanabe, Higashiosaka, Japan

[73] Assignee: Sharp Kabushiki Kaisha, Osaka, Japan

[21] Appl. No.: 676,617

[22] Filed: Dec. 4, 1984

Related U.S. Application Data

[63] Continuation of Ser. No. 393,611, Jun. 30, 1982, abandoned.

[30] Foreign Application Priority Data

Jul. 6, 1981 [JP] Japan ..... 56-106145
Jul. 6, 1981 [JP] Japan ..... 56-106146

[51] Int. Cl.[4] ..... H05B 6/64
[52] U.S. Cl. ..... 219/10.55 B
[58] Field of Search ..... 219/10.55 B, 10.55 R

[56] References Cited

U.S. PATENT DOCUMENTS

| | | | |
|---|---|---|---|
| 3,569,656 | 3/1971 | White et al. | 219/10.55 B |
| 4,097,707 | 6/1978 | Kobayashi et al. | 219/10.55 B |
| 4,162,381 | 7/1979 | Buck | 219/10.55 B |
| 4,317,977 | 3/1982 | Buck | 219/10.55 B |
| 4,350,860 | 9/1982 | Ueda | 219/10.55 B |
| 4,376,131 | 3/1983 | Mori et al. | 426/231 |
| 4,383,158 | 5/1983 | Niwa | 219/10.55 B |

FOREIGN PATENT DOCUMENTS 0000957 3/1979 European Pat. Off. ..... 219/10.55 B

*Primary Examiner*—C. L. Albritton
*Assistant Examiner*—M. M. Lateef
*Attorney, Agent, or Firm*—Birch, Stewart, Kolasch & Birch

[57] ABSTRACT

In a preferred form of an "auto cooking" microwave heating appliance, there are provided two sensors, typically, a gas sensor and a heat-sensible element (i.e. thermistor) within a passageway for outgoing air from a heating chamber. In addition to a switching means for controlling an enabling circuit for a microwave source such as a magnetron, a cook switch is provided which is common to all of the different kinds of foodstuff to be heated. A microcomputer is provided which generates a heating stop instruction for the enabling circuit for the microwave source in response to not only output signals from the heat-sensible element and the gas sensor but also a stored program in the microcomputer. Based upon the rate of timewise variations in the output signal from the gas sensor, the microcomputer decides what kind of foodstuff is being heated and then establishes an intended final level at which the gas sensor shall reach at the end of heating and an intended final level at which the heat-sensible element shall reach at the end of heating. A heating end instruction is issued when both the gas sensor and the heat-sensible element reach their intended final levels.

5 Claims, 12 Drawing Figures

MICROWAVE HEATING APPLIANCE WITH SIMPLIFIED USER'S OPERATION

This application is a continuation of application Ser. No. 393,611 filed on June 30, 1982, now abandoned.

BACKGROUND OF THE INVENTION

This invention relates to a heating appliance and more particularly to a microwave heating appliance with capability of deciding based upon timewise variations in a voltage at a terminal of such an atmosphere sensor as a gas sensor, what kind of foodstuff is being heated and if the heating of the foodstuff is completed.

In the recent years, automatic cooking appliances of the microwave oven type have been placed on the market, in which an atmosphere sensor such as a gas sensor is installed to aid the appliance in deciding if the cooking of the foodstuff is completed. This sort of appliances however further requires a predetermined number of keys which are assigned to different kinds of foodstuffs to set unique heating temperatures, with the result in user inconvenience in using the appliances.

As seen in FIG. 1 illustrating a conventional appliance, the predetermined number of keys $K_1$, $K_2$, $K_3$ and so forth are provided for different kinds of foodstuffs. Different heating temperatures are preset in conjunction with each of these keys. Typically, the heating temperature is 70°–80° C. for the first key $K_1$ appropriate for side dishes and china bowl, 50°–60° C. for the second key $K_2$ appropriate for heated "sake" and about 100° C. for prepared or preheated material such as spinach. The user must select one of these keys and sets a desired heating temperature, depending upon what kind of foodstuff is to be heated.

OBJECT AND SUMMARY OF THE INVENTION

Accordingly, it is an object of the present invention to provide a microwave heating appliance which eliminates the need to utilize a predetermined number of keys each for different kinds of foodstuff.

It is another object of the present invention to provide a microwave heating appliance which has capability of deciding from timewise variations in a terminal voltage in an atmosphere sensor such as a gas sensor what kind of foodstuff is being heated and calculating a final heating temperature appropriate for the foodstuff being heated, thus eliminating the need for individual keys for various kinds of foodstuff.

In carrying out the objects above described, the present invention provides a microwave heating appliance which comprises a heating chamber in which foodstuff is heated, a sensor for sensing a factor concerning the atmosphere where heating is effected in the heating chamber of the appliance and providing a voltage indicative of variations in the factor, means for deciding, from timewise variations in the voltage derived from the sensor, what kind of foodstuff is being heated and if the heating of foodstuff is completed, and means for governing the heating in the heating chamber in response to the output of the deciding means.

In a preferred form of the present invention, there are provided two sensors, typically, a gas sensor and a heat-sensible element (i.e. thermistor) within a passageway for outgoing air from the heating chamber. In addition to a switching means for controlling an enabling circuit for a microwave source such as a magnetron, a cook switch is provided which is common to all of the different kinds of foodstuff to be heated. A microcomputer is provided which generates a heating stop instruction for the enabling circuit for the microwave source in response to not only output signals from the heat-sensible element and the gas sensor but also a stored program in the microcomputer. Based upon the rate of timewise variations in the output signal from the gas sensor, the microcomputer decides what kind of foodstuff is being heated and then establishes an intended final level which the gas sensor shall reach at the end of heating and an intended final level which the heat-sensible element shall reach at the end of heating. A heating end instruction is issued when both the gas sensor and the heat-sensible element reach their intended final levels. Though the two sensors are installed to ensure exact determination as to the kind of foodstuff being heated, only one of these sensors is sufficient for the purpose of the present invention.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
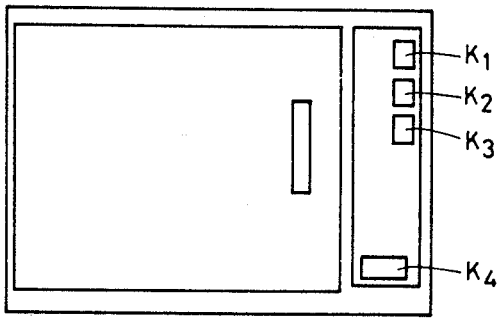
FIG. 1 PRIOR ART
FIG. 1 is a front view showing the appearance of a conventional appliance.
Figure 2:
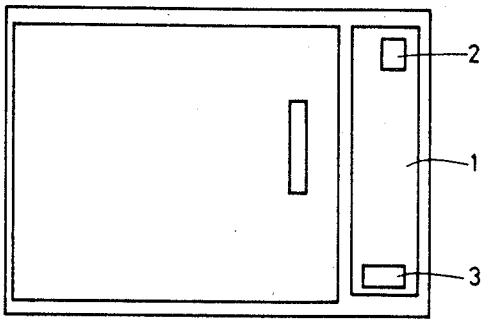
FIG. 2 is a front view of a microwave heating appliance according to an embodiment of the present invention.
Figure 3:
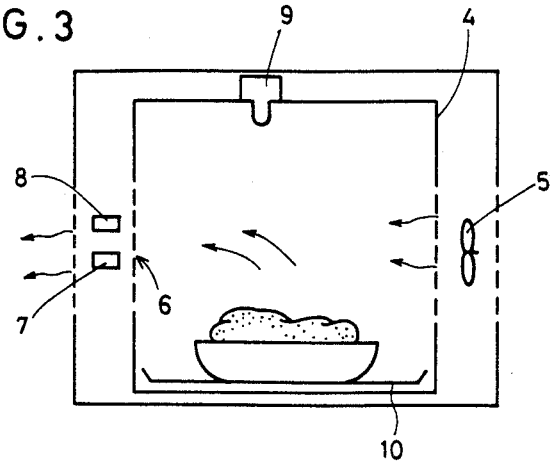
FIG. 3 is a vertical cross sectional view of the appliance as shown in FIG. 2.
Figure 12:
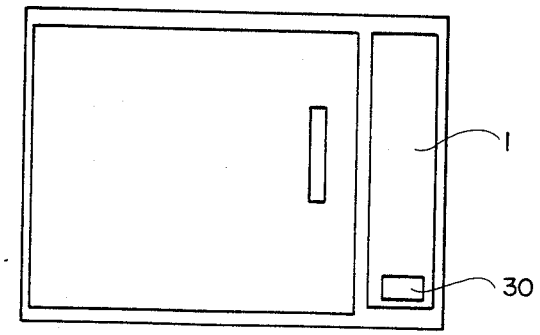
FIG. 12 is a front view of an alternative embodiment of the microwave heating applicance of the present invention.

Referring now to FIG. 2, there is illustrated in front view the appearance of a microwave heating appliance according to an embodiment of the present invention, wherein there are provided on an operational panel 1 an "auto heating" key 2 and a cook key 3. It is possible that both the keys 2 and 3 may be made up as a combined single key 30 (see FIG. 12). FIG. 3 shows in cross section the microwave heating appliance according to the present invention. A blower 5 is disposed on one side of a heating chamber 4 and a gas sensor 7 and a thermistor 8 are disposed in a passageway 6 for outgoing air on the other side of the heating chamber. The gas sensor 7 shows variations in resistance as a function of the concentration of exhaust gas expelled from foodstuff, while the thermistor 8 varies in resistance as a function of exhaust air temperature monitored as the heating foodstuff proceeds. There are further provided a magnetron 9 for generation of microwave radiation and a turntable 10 on which foodstuff is mounted.

Figure 4:
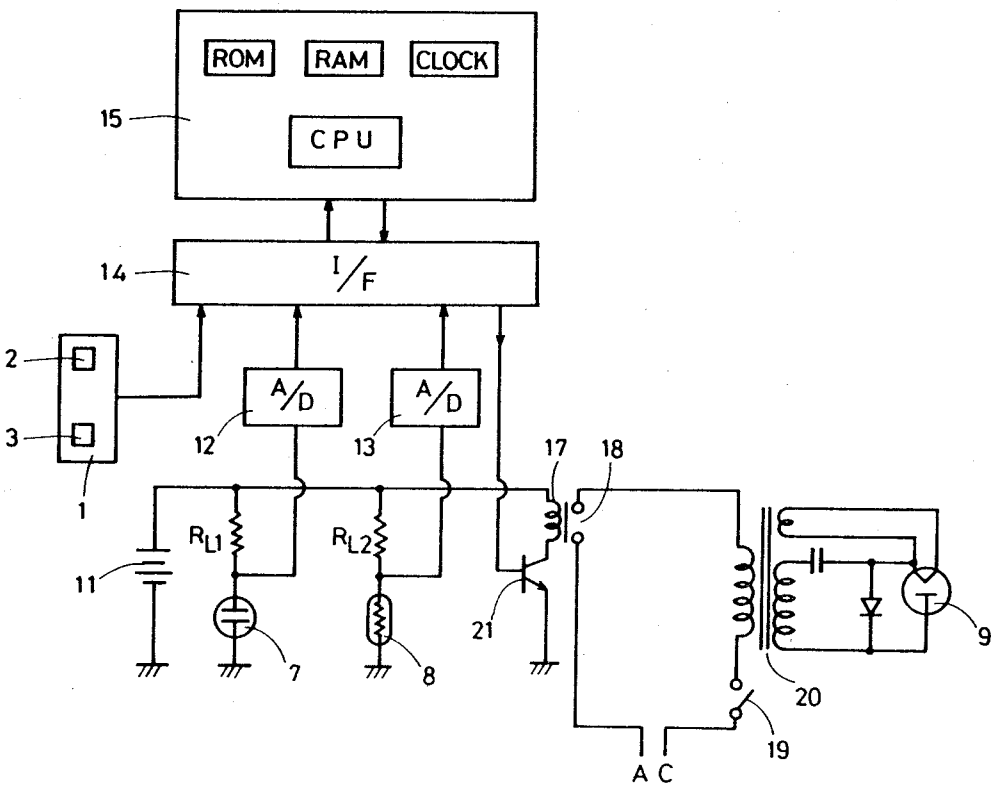
FIG. 4 is a circuit diagram of appliance according to the embodiment of the present invention.

FIG. 4 shows a circuit diagram of the above illustrated heating appliance. The gas sensor 7 is connected via a load resistor $RL_1$ and the thermistor 8 is connected via a load resistor $RL_2$ to a DC power source 11. A terminal voltage $V_G$ at the gas sensor 7 and a terminal voltage $V_T$ *at the thermistor* 8 *are supplied to a central processing unit (CPU) in a microcomputer* 15 *by way of analog-to-digital converters* 12 *and* 13 *and an input/output interfaces* 14, *respectively. As is well known in the art, the microcomputer* 15 *includes a read only memory ROM, a random access memory RAM and a clock generator for storage of a program or programs or the like in addition to the CPU. Key signals on the operational panel* 1 *are also supplied to the microcomputer* 15 *via the interface* 14. *The magnetron* 9 *is excited with a utility AC power source* 16 *via a contact* 18 *of a microwave enabling relay* 17, *a door switch* 19, *a booster transformer* 20, *etc. The microwave enabling relay* 17 *is energized under an instruction from the CPU via the interface* 14 *and a transistor* 21.

In the above embodiment, the microcomputer may be implemented with MZ-80C, the interface with MZ-80I/O and univeral I/O card MZ-80I/O1, and the analog-to-digital converters with PIO-2025, the first two components available by Sharp Co., Japan and the last component available by I.O data equipment Co., Japan.

Figure 5:
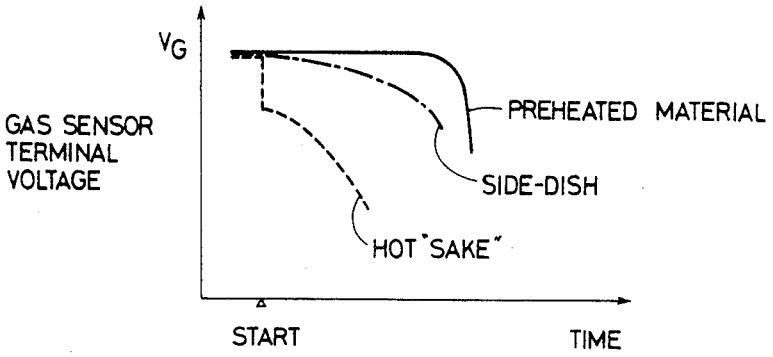
FIG. 5 is a characteristic chart for explaining the operating principle of foodstuff kind decision as taught by the present invention.
Figure 6:
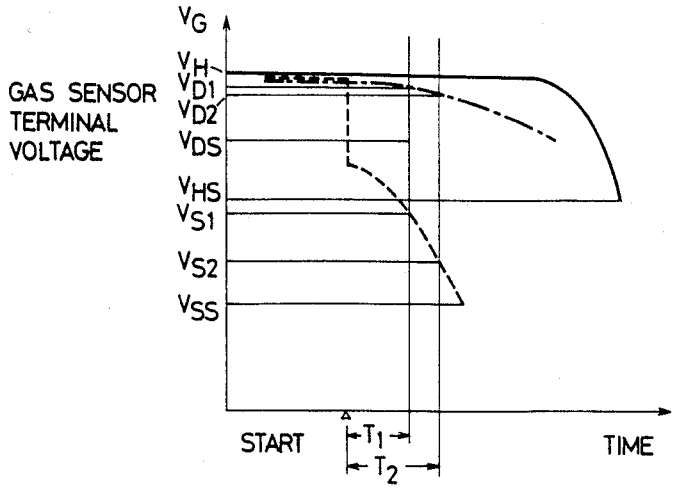
FIG. 6 is a characteristic chart for showing operation of the appliance according to the embodiment of the present invention.

FIG. 5 illustrates how the terminal voltage $V_G$ at the gas sensor 7 varies during the course of microwave heating when time has gone by. The history of variations in the terminal voltage $V_G$ is dependent primarily upon the kind of foodstuff especially the components of foodstuff. That is, different components in foodstuff show unique boiling points, for example, 78.3° C. for ethyl alcohol, 118° C. for acetic acid and 20.8° C. for acetaldehyde.

Figure 7:
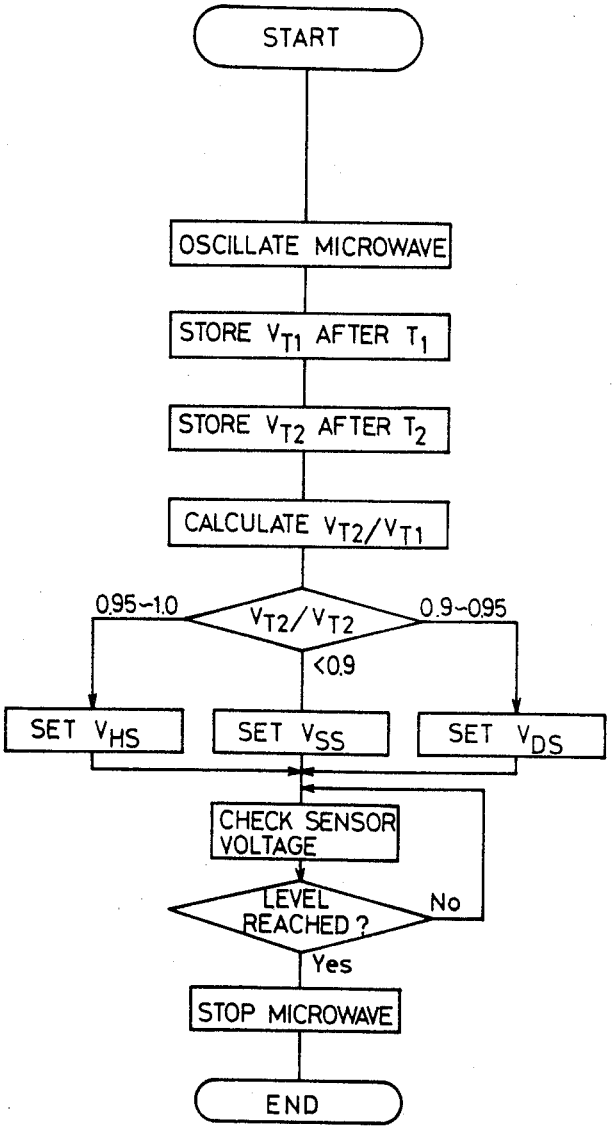
FIG. 7 is a flow chart showing the contents of a program stored in A ROM in a microcomputer 15 in the illustrated appliance.
Figure 8:
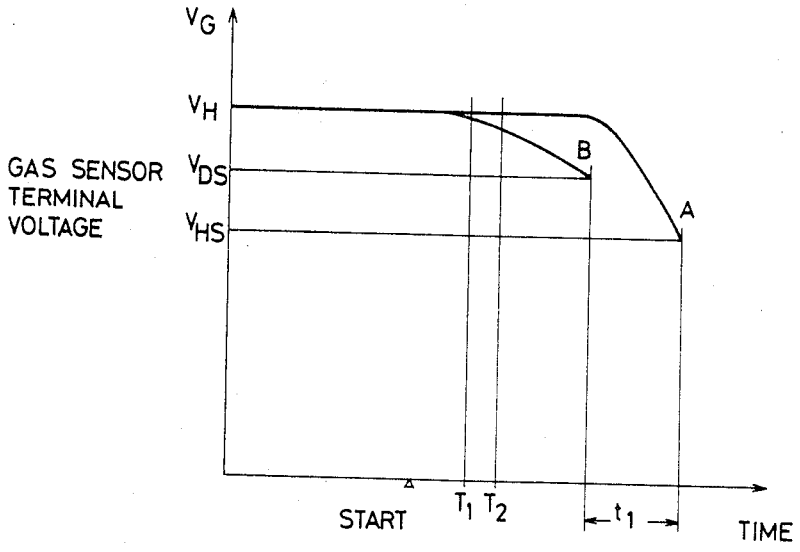
FIGS. 8 through 11 are characteristic charts for explaining another embodiment of the present invention.

Operation of the heating appliance according to the illustrated embodiment will now be discussed by reference to FIGS. 7 and 8.

When the "auto heating" key 2 and then the cook key 3 are pressed, the input signals are accepted by the CPU which in turns instructs the microwave enabling relay 17 to be energized to trigger the generation of microwave radiation from the magnetron 9 and to start the heating of foodstuff. After a time $T_1$ has passed after the beginning of heating, then the instantaneous terminal voltage $V_{T1}$ at the gas sensor is stored in the RAM. When a time $T_2$ has expired after the beginning of heating, then the instantaneous terminal voltage $V_{T2}$ at the gas sensor is loaded into the RAM. An arithmetic portion of the CPU calculates $V_{T2}/V_{T1}$. Based upon the resulting ratio $V_{T2}/V_{T1}$, the CPU decides what kind of foodstuff is being heated and establishes the optimum heating temperature for different kinds of foodstuff. Assuming $T_1=30$ sec and $T_2=40$ sec, $V_{T2}/V_{T1}=V_{S2}/V_{S1}<0.9$ for heated "sake" and $V_{T2}/V_{T1}=V_{D2}/V_{D1}=0.9$–$0.95$. For prepared food material normally wrapped within a thin film, $V_{T2}/V_{T1}=V_{H2}/V_1$ falls within 0.95–1.0 because no gas is given off before a given vapor pressure is reached. It shall be noticed that $V_{H1}=V_{H2}=V_H$ in FIG. 7.

The kind of foodstuff is being heated is decided by the ratio $V_{T2}/V_{T1}$ as noted eariler. When the ratio is within 0.95–1.0, there is established a detection level $V_{HS}$ appropriate for satisfactory heating of prepared or preheated material. When it falls within 0.9–0.95, a detection level $V_{DS}$ or the optimum heating temperature appropriate for good cooking of rice or a china bowl. With a value less than 0.9, a detection level is set at $V_{SS}$ suitable for heating "sake." Continued checkup of the gas sensor voltage $V_G$ is conducted to decide if microwave radiation is to be interrupted.

As stated above, it is therefore possible to decide from the value of the ratio $V_{T2}/V_{T1}$ what kind of foodstuff is being heated. It is further possible to establish detection levels $V_{HS}$, $V_{DD}$ and $V_{SS}$ for a respective kind of foodstuff, at which a heating stop instruction $V_G$ is to be issued.

However, in some cases the heating may be stopped before foodstuff is satisfactorily and completely heated, should the critical levels $V_{HS}$, $V_{DD}$ and $V_{SS}$ concerning the provision of the stop instruction or voltage level $V_G$ be decided only by the terminal voltage $V_G$ from the gas sensor. One of the reasons for this is that the user may fail to wrap prepared or preheated material with a plastic film. As depicted in FIG. 8, the gas sensor shows the curve A for prepared and preheated material and the ratio $V_{T2}/V_{T1}$ is more than 0.95 under normal condition. However, in this case the ratio is as low as 0.94 and the heating load is misunderstood as side dishes or china bowl. A program as shown by the curve B is selected so that heating is discontinued at $V_{DS}$ bofore the optimum level $V_{HS}$ is reached. Consequently, cooking is completed $t_1$ earlier.

Figure 9:
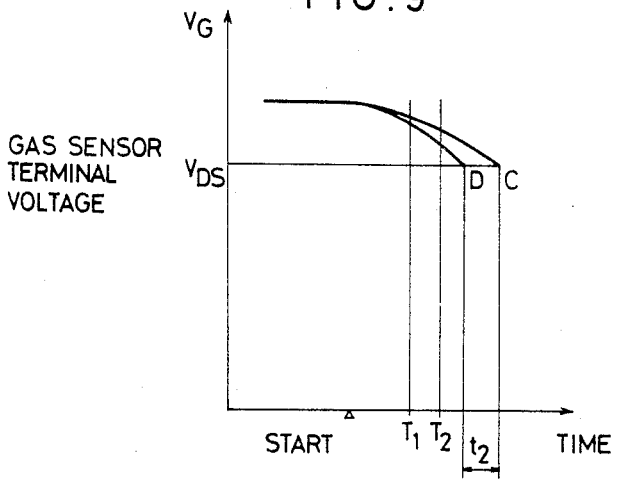
Figure 10:
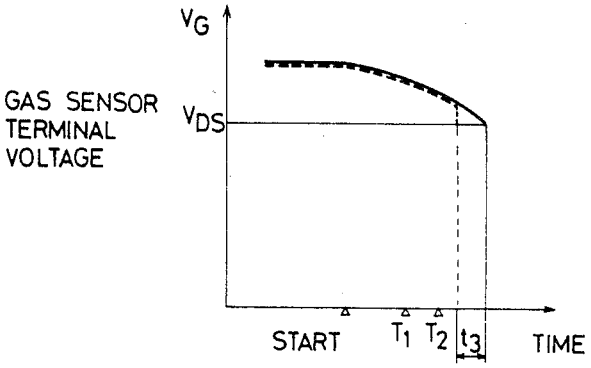

The second reason is deviations in the operating characteristics of the gas sensor. Since the sensitivity $\beta$ of the gas sensor in a abnormal condition such as heating with no load becomes smaller than that in normal a condition, the time where the level $V_{DS}$ is reached varies to point D rather than the which would be reached under normal conditions, as seen in FIG. 9. Cooking is completed $t_2$ earlier. It is noted that $\beta$ is a ratio $R_B R_A$ where $R_A$ is the resistance of the sensor at a particular gas of A ppm and $R_B$ is that at a particular gas of B ppm.

Figure 11:
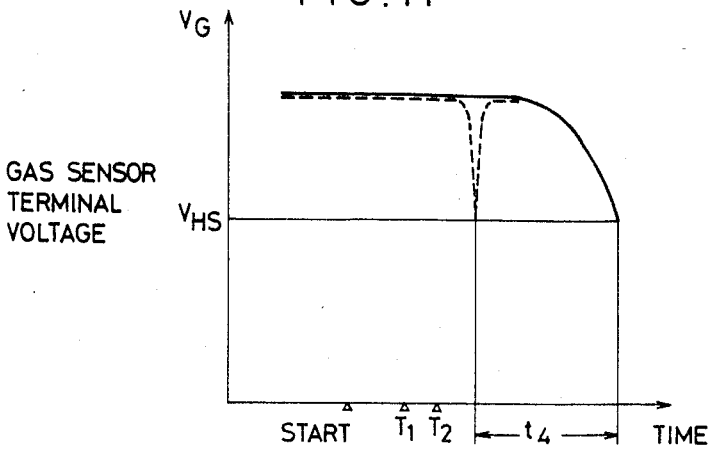

The last reason is that $V_G$ may drop abruptly as depicted by the dot line in FIG. 11 when an electrode-to-electrode path of the sensor is short-circuited or external noise is overriden on the terminal voltage $V_G$ at the sensor. In this case, cooking is completed $t_3$ or $t_4$ earlier.

In another embodiment, the detection level of the thermistor is set at different levels, based upon the kind of foodstuff in a likewise manner. Typically, the thermistor level $T_{SS}$ is set at 55° C. for heated "sake" with $V_{T2}/V_{T1}<0.9$ and at 90° C. for rice or china bowl with $V_{T2}/V_{T1}=0.9$–$0.95$ and about 100° C. for preheated material with $V_{T2}/V_{T1}$. Microwave heating is therefore stopped when both the terminal voltage $V_G$ of the gas sensor 7 and the terminal voltage $V_T$ of the thermistor 8 reach their optimum levels. It is also obvious that the kind of foodstuff as determined by $V_{T2}/V_{T1}$ may be visually displayed.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A microwave heating system comprising:

a heating chamber in which a foodstuff may be placed for cooking;

microwave cooking means for applying microwave energy to the interior of said heating chamber to cook said foodstuff;

gas sensor means disposed for monitoring gas in said chamber and producing a gas signal indicative thereof;

means for monitoring the timewise variation of said gas signal from sampled values of said gas signal at different sample times and for determining the desired final level of said gas signal from said timewise variation, said desired final level of said gas signal being different from said sampled levels, said means for monitoring developing a first signal when said desired final level of said gas signal is achieved;

control means for enabling said microwave cooking means, said control means disabling said microwave cooking means upon receipt of said first signal.

2. The microwave heating system of claim 1 further comprising:

temperature sensor means disposed for monitoring a temperature in said chamber and producing a temperature signal indicative thereof;

second means for monitoring the timewise variation of said temperature signal from sampled values of said temperature signal at different sample times and for determining the desired final level of said temperature signal from its timewise variation, said desired final level of said temperature signal being different from said sampled temperature values, said second means for monitoring developing a second signal when said desired final level of said temperature signal is achieved;

said control means disabling said microwave cooking means upon receipt of both said first and second signals.

3. The microwave heating system of claim 2 wherein said gas sensor means and said temperature sensor means are disposed in a passageway adjacent said heating chamber; said passageway allowing air to exit said chamber.

4. The microwave heating system of claim 3 further comprising a single cook switch operatively interconnected to said control means which when activated causes said control means to enable said microwave cooking means.

5. A microwave heating system comprising:

a heating chamber in which a foodstuff may be placed for cooking;

microwave cooking means for applying microwave energy to the interior of said heating chamber to cook said foodstuff;

temperature sensor means disposed for monitoring a temperature signal from the sampled values of said temperature signal at different sample times and for determining the desired final level of said temperature signal from said timewise variation, said desired final level of said temperature signal being different from said sampled values, said means for monitoring developing a control signal when said desired final level of said temperature signal is achieved;

control means for enabling said microwave cooking means, said control means disabling said microwave cooking means upon receipt of said control signal.

* * * * *